US005269429A

United States Patent [19]

Schumacher

[11] Patent Number: 5,269,429

[45] Date of Patent: Dec. 14, 1993

[54] CLOSURE CAP FOR INFUSION OR TRANSFUSION BOTTLES

[75] Inventor: Clemens Schumacher, Sundern, Fed. Rep. of Germany

[73] Assignee: Robert Finke GmbH & Co. KG, Finnentrop, Fed. Rep. of Germany

[21] Appl. No.: 960,213

[22] Filed: Oct. 13, 1992

Related U.S. Application Data

[63] Continuation of Ser. No. 698,669, May 10, 1991, abandoned.

[30] Foreign Application Priority Data

May 15, 1990 [DE] Fed. Rep. of Germany ..... 4015510

[51] Int. Cl.[5] ..... B65D 41/62

[52] U.S. Cl. ..... 215/249; 215/254; 215/256; 215/274; 215/277

[58] Field of Search ..... 215/225, 247, 249, 251, 215/254, 256, 274, 277

[56] References Cited

U.S. PATENT DOCUMENTS

| | | | |
|---|---|---|---|
| 809,213 | 1/1906 | Osgood | 215/251 |
| 3,439,825 | 4/1969 | Glensky | 215/251 |
| 3,630,404 | 12/1971 | Guala | 215/251 |
| 3,698,584 | 10/1972 | Miller . | |
| 3,779,412 | 12/1973 | Kirton | 215/225 |
| 3,866,782 | 2/1975 | Westfall | 215/253 |
| 3,871,544 | 3/1975 | Peyser | 215/225 |
| 3,893,582 | 7/1975 | Kowalik | 215/221 |
| 4,260,067 | 4/1981 | Andruchiw | 215/225 |
| 4,279,353 | 7/1981 | Honma | 215/254 |
| 4,471,879 | 9/1984 | Connor et al. . | |
| 4,516,684 | 5/1985 | Walter | 215/272 |
| 4,520,942 | 6/1985 | Dwinell . | |
| 4,577,771 | 3/1986 | Martinez | 215/256 |
| 5,048,706 | 9/1991 | de Vaujany | 215/251 |

FOREIGN PATENT DOCUMENTS

| | | |
|---|---|---|
| 2716447 | 4/1977 | Fed. Rep. of Germany . |
| 3715175 | 11/1988 | Fed. Rep. of Germany . |
| 2176497 | 3/1972 | France . |
| 8700799 | 4/1987 | Netherlands . |

*Primary Examiner*—Allan N. Shoap
*Assistant Examiner*—Nova Stucker

[57] ABSTRACT

The present invention relates to a closure cover (V) for infusion or transfusion bottles, having a stopper (6) which is adapted to the bottle neck (3) and is extended over by a cap (8) which is anchored by undergripping on the bottle neck (3), and it proposes in order to obtain a solution which is particularly advantageous from a structural standpoint, that the undergripping of the cap (8) is obtained by resilient individual tongues (10) which are secured in the undergrip position by a sliding ring (15) surrounding them, the cap having tabs biased outward from the bottle neck for serving at the same time to secure the sliding ring (15) in its support position.

17 Claims, 4 Drawing Sheets

CLOSURE CAP FOR INFUSION OR TRANSFUSION BOTTLES

RELATED APPLICATION

This application is a continuation of my co-pending application Ser. No. 07/698,669 filed May 10, 1991, abandoned.

FIELD AND BACKGROUND OF THE INVENTION

The present invention relates to a closure cover for infusion or transfusion bottles.

A closure cover of this type is known, for instance, from Federal Republic of Germany Patent 37 15 175. In that case, the stopper is secured by the conventional flanged cap. An opening left in the top of the flanged cap permits access of a cannula or the transfusion fitting. In its original state this opening is kept closed by means of a plastic lid which at the same time forms a germ-proof barrier. The lid can be torn off when desired. Score lines produced by a weakening of the thickness of the material of the plastic lid facilitate this.

From U.S. Pat. No. 4 520 942 it is known to transversely divide a metal cap surrounding a plastic lid in order to obtain access. For this purpose, the metal cap has diametrically extending predetermined tear lines which define a transverse tab. The free ends of the portion delimiting the transverse tab are continued at both ends into a peripheral, free-standing pull tab.

From U.S. Pat. No. 3 698 584 it is furthermore known to provide a screw cover of a container with an axially displaceable annular collar which on its inner side has ledges which lock the rotation of the screw cap and cooperate with mating locking means on the neck of the container. This development provides security against children.

SUMMARY OF THE INVENTION

The object of the present invention is to improve, by structurally simple means, the customary flanging of the stopper covering while retaining the customary firmness of attachment.

As a result of this development of the invention, there is created a closure cover of this type which satisfies the basic requirement of a antiseptic seal as well as that of an attachment which remains stable in use, but with which the flanging, which requires special devices, is dispensed with. Mounting can be effected by simply placing the parts one on the other. Nevertheless, the number of parts is not increased. Specifically, one proceeds in this connection in the manner that the undergripping on the part of the cap is obtained by resilient individual tongues which are held in the undergripping position by pressing by a displaceable ring which surrounds them, the pressing means serving at the same time to secure the sliding ring in its pressing position in the manner that the supporting means on their part grip below locking tongues on the cap. The sliding ring, which advantageously acts as a pressing hoop, can be moved into its active locking position with relatively little force; it can be pulled off only with recognizable damage to the parts which produce the detent engagement obtained; any tampering with the original closure is clearly recognizable. From a structural standpoint and also for a balanced loading of the parts providing the detent connection, it has proven advisable for the individual tongues and the locking tongues to be provided in alternate sequence on the periphery of the cap. The cap may advisedly be of a construction of rotational symmetry, although other cross-sectional shapes of a non-circular type would also be conceivable. From the standpoint of stability, it is furthermore advantageous for the sliding ring to have an angular profile in cross section and for the arm of the angle which is directed radially inward to the stopper to extend on the outer surface of the cap in the region above the roots of the individual tongues and of the locking tongues. With a suitable angular cross section, a surprisingly small thickness can be used; for the guidance there are used surfaces which are in any event present, namely in this case the outer surface of the cap. Furthermore, a favorable development results from a tear-open tab in the central region of the top of the cap, which tab is formed by an annular surface. In this way, a precisely defined central opening for the aforementioned accessibility can be obtained in an instant. Upon the tearing open and exposing of the puncture region, there is furthermore no danger of injuring oneself. In addition, the puncture region remains sterile until the tearing open. Such a tear tab may advisedly be continued furthermore by a pull tab, for instance in the form of a pull ring. The annular surface is limited by score lines impressed into the bottom of the cap. These lines can easily be produced upon the molding of the cap part, which is made of plastic. It is furthermore proposed that the pressing means of the sliding ring be developed as annular ribs with rounded peak having a nose-shape in cross section. This results in an attachment in the basic locked position which is favorable for sliding without any lifting action. The corresponding assembly is furthermore optimized by the fact that the lower flank of the annular rib is developed as a run-on bevel. In this connection, it is furthermore favorable that the upper flank (back of the nose) of the annular rib be the locking flank which cooperates with the locking tongues. The locking flank can be substantially flatter; it advisedly extends at right angles to the lengthwise direction of the locking tongues. In addition, the invention proposes that the sliding ring be provided with a place of intended breakage. In this way the sliding ring can be detached upon manual rotation, for instance upon so-called recycling. In order, despite the high intrinsic stability of the locking rings which already results from a certain transverse rounding of them and despite the considerable thinness of the wall, the invention finally proposes that the individual tongues be developed with an angular cross section such that the end surface of the outward directed angle leg form the pressing place of the annular rib. The stresses are therefore produced at a place of increased accumulation of material. All of this is optimized furthermore in the manner that the peripheral angular space of the individual tongues is stiffened by ledges. Such ledges, which connect the two legs with each other, can readily be formed upon the injection molding. The ledges however, in addition to their said stiffening function, also perform another advantageous function in that the upper end surface of the ledges forms the vertical limitation for the sliding ring in position engaged on the cap. This top limitation of the end surface also exerts an inward directed load on the individual tongues. The aforementioned angle leg, in advantageous manner, forms the counter stop on the sliding-ring side.

BRIEF DESCRIPTION OF THE DRAWINGS

The object of the invention is explained in further detail below with reference to an embodiment shown in the drawing, in which.

DETAILED DESCRIPTION OF THE PREFERRED EMBODIMENT

Figure 1:
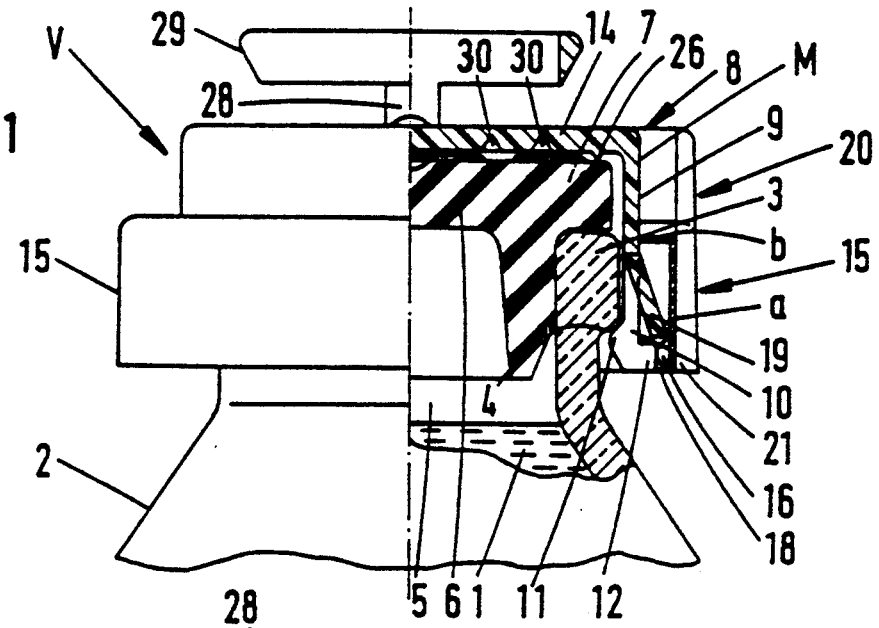
FIG. 1 is a half section through the closure cover placed on an infusion or transfusion bottle.
Figure 2:
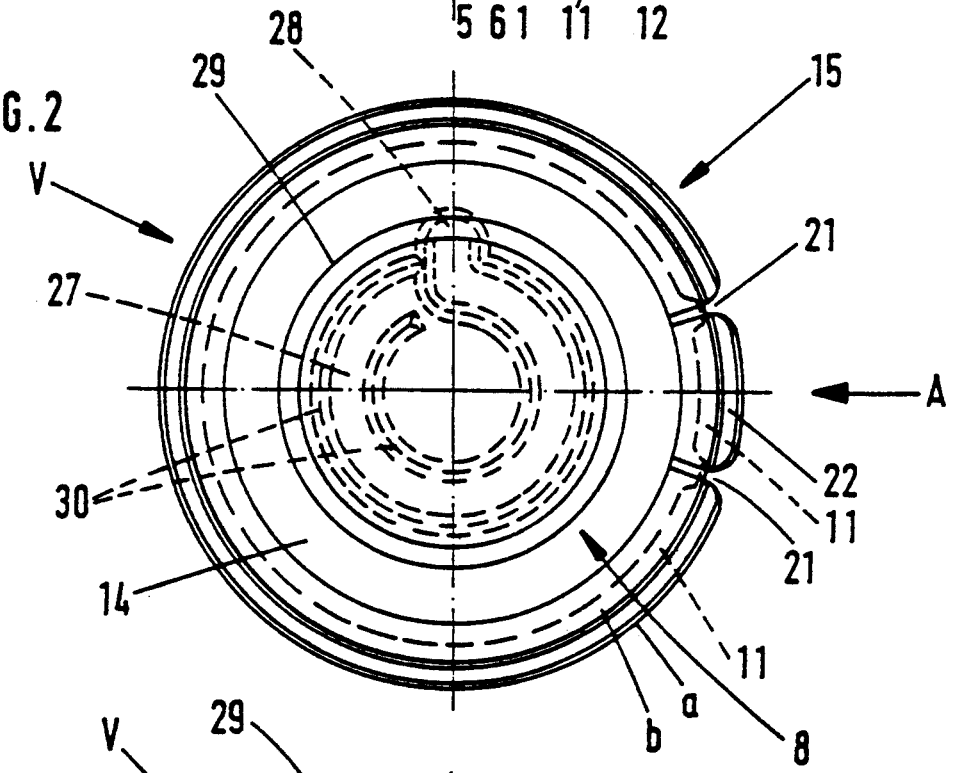
FIG. 2 is a top view thereof.
Figure 3:
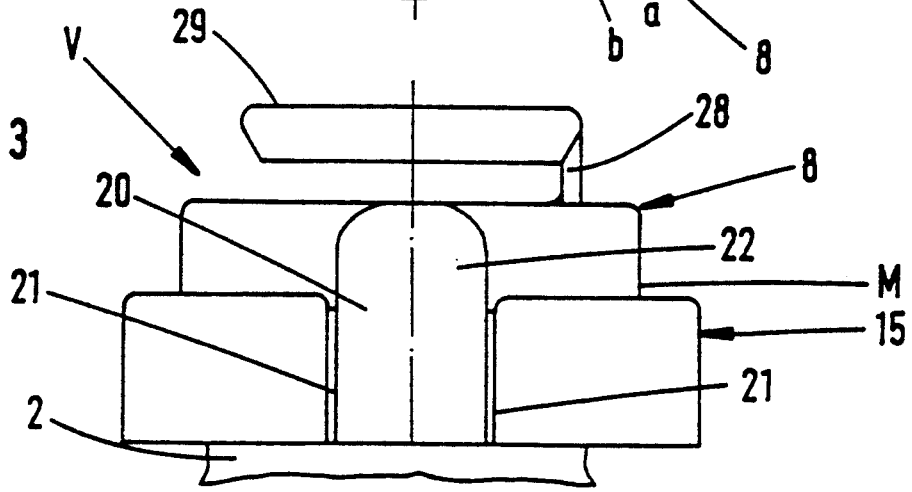
FIG. 3 is a side view, seen from the direction A in FIG. 2.
Figure 4:
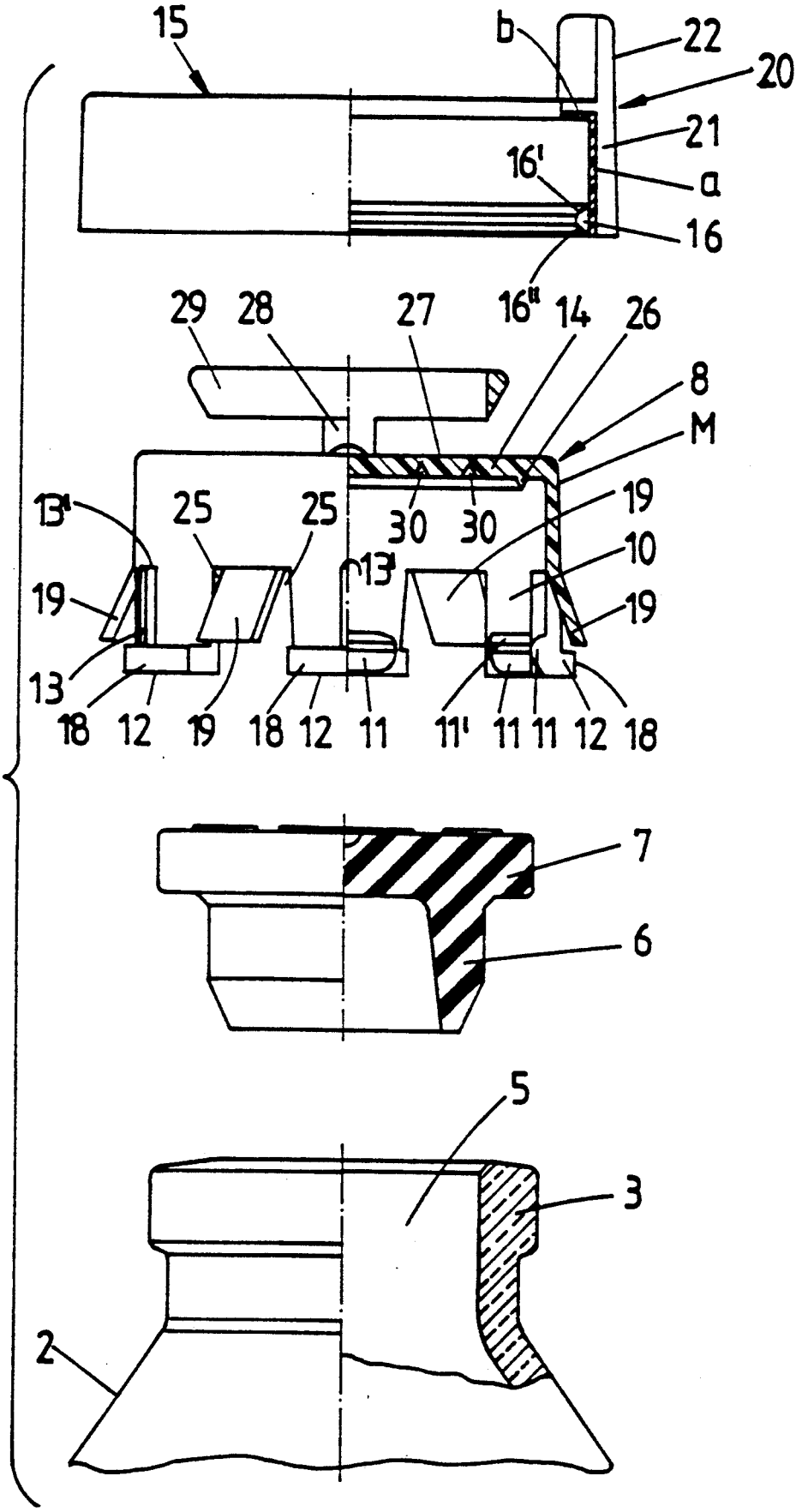
FIG. 4 shows the closure cover in an exploded view, showing the bottle neck.

The bottle 2, which can be secured by a closure cover V and contains an infusion or transfusion liquid 1, passes via a conically tapering section into the bottle neck 3 of reduced cross section. The neck is developed as a so-called beaded neck, i.e. it has peripherally an annular bead which is produced by an accumulation of material and the lower flank of which forms an undergrip locking shoulder 4.

The infusion or transfusion bottle, as a general rule, consists of glass.

A stopper 6 of suitable cross section is pressed into the mouth cavity 5 of the bottle neck 3. The stopper consists of rubber or similar elastic material. It is a hollow stopper the lower outer edge of which is beveled, creating an end cone. An annular collar 7 extends over the front end of the bottle neck 3. The front end drops slightly outward at an acute angle. The substantially cylindrical circumferential surface of the edge collar 7 is located slightly backward with respect to the corresponding circumferential surface of the bottle neck 3 or annular bead.

Another component of the closure cover V is a cap 8 which is anchored on the bottle neck 3, under which it grips. This cap consists of plastic (PP). For its anchoring, its annular cap wall 9 is formed of resilient, i.e. outwardly springable, individual tongues 10 These are tabs of material which are cut from the lower edge of the cover wall 9. These tabs of material which act like detent fingers form, within the lower end region, an inward directed detent bead 11 the upper flank 11' of which extends in locking manner below the undergrip locking shoulder 4.

Figure 8:
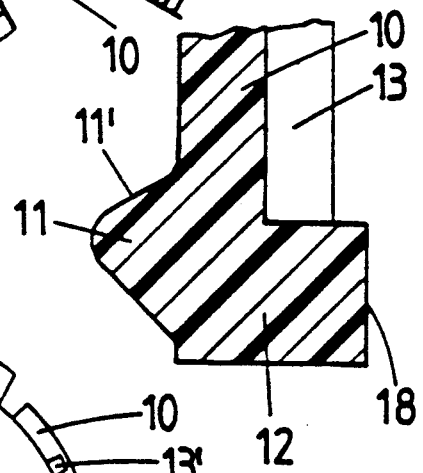
FIG. 8 is a section along the line VIII—VIII of FIG. 6, in a showing considerably enlarged as compared with FIG. 6 and showing the lower section of an individual tongue.

As can be noted from the drawings (see, in particular, FIG. 8), the individual tongues 10 are developed practically angular in cross section. Due to the shorter outward pointing angle leg, there results a sort of L-structure which, with the inclusion of the accumulation of material forming the detent bead 11, can even be referred to as a hammerhead profile. The outwardly directed angle leg which extends out on the back of the detent bead 11 is designated 12.

Although the individual tongues 10, as a result of the said hammerhead profile, already have a high degree of stability despite the relatively slight wall thickness of the cap 8, good stability is present already solely due to the annular arching. This stability is however further increased by the fact that the peripheral angular space of the individual tongues 10 is further stiffened by a ledge 13. The latter extends axially at least over the length of the individual tongues in centered position. It terminates on top at the height of the root of each individual tongue 10.

In order to secure the attached position shown in FIG. 1 in which the cover 14 of the cap 8 presses the annular collar 7 in sealing fashion against the end surface of the bottle neck 3, there is provided a sliding ring 15 which peripherally surrounds the individual tongues 10. This ring also consists of plastic (PP). This sliding ring in locked position prevents the moving outward of the resilient individual tongues 10 so that the closure cap V cannot be easily pulled off. Therefore, there is security comparable to the conventional flanged undergripping. To be sure, the security position is obtained without the use of a special device, namely simply by pushing the sliding ring from above onto the outer wall of the cap 8 which guides the sliding ring 15.

Figure 11:
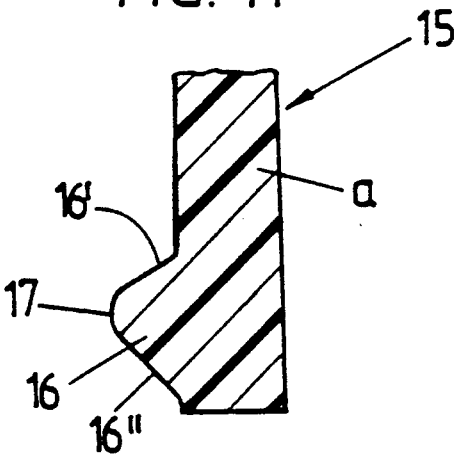
FIG. 11 is a section along the line XI—XI of FIG. 10, showing the lower section of the locking tongue, again considerably enlarged.

Specifically, the pressing part of the sliding ring which secures the individual tongues at the back against moving out or backward is developed as an annular rib 16 which is nose-shaped in cross section. Its vertex 17, as can be noted from FIG. 11, is convexly rounded and is in contact pressing position on the peripheral end surface 18 of the angle arm 12 of the individual tongues 10 which form the place of pressing.

For the fixing in position or securing of the sliding ring 15 itself, the said pressing means are also utilized in the manner that the annular rib 16 which forms the pressing means in its turn grips below locking tongues 19 on the cap 8. The locking tongues 19, like the individual tongues 10, are tabs cut out of the cap wall 9. They are also directed downward, but are bent outward at an acute angle, as can be clearly noted from FIG. 1. The outward angle is about 20°. To be sure, the locking tongues 19 are of somewhat shorter length than the individual tongues 10 due to the position in space of the annular rib 16 on the surface 16' of which the free front ends of the locking tongues 19 engage. In the drawing, the corresponding front end is directed horizontally, while the corresponding upper flank 16' extends obliquely inward. The angle of obliqueness of the upper flank 16' is 30°. The outer edge of the locking tongue 19 enters in knife-like manner into the inner vertex of the annular space formed by the upper flank 16' and of the inner surface of the sliding ring 15. Alternatively, of course, one can also proceed in the manner that the end surface of the locking tongues 19 sits snugly on the upper flank 16'.

The inner edge of the end surface of the locking tongues 19 terminates vertically in the same plane as the end surface 18 of the angle arm 12.

The lower flank 16" of the annular rib 16 is developed as run-on surface or bevel. Its outward and downward directed inclination is 45°. The sliding ring 15 is detachable from the cap 8 by an intended breaking point 20 formed of two parallel intended break notches 21. This place of intended breakage is oriented axially. The intended break notches 21 are about a finger-width apart.

Figure 9:
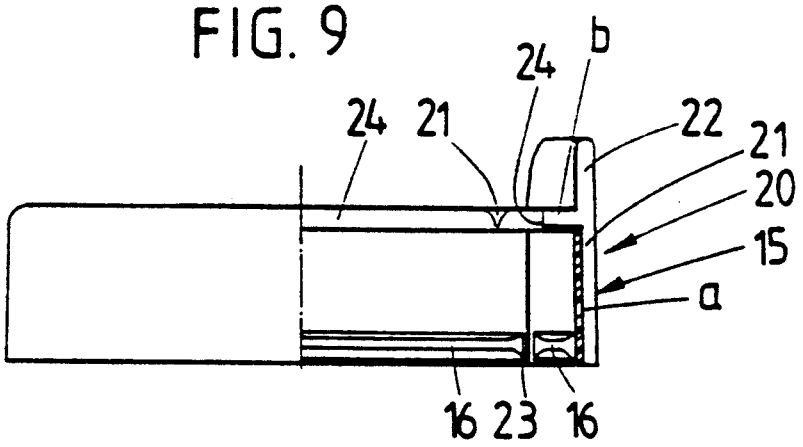
FIG. 9 is a half section through the sliding ring.
Figure 10:
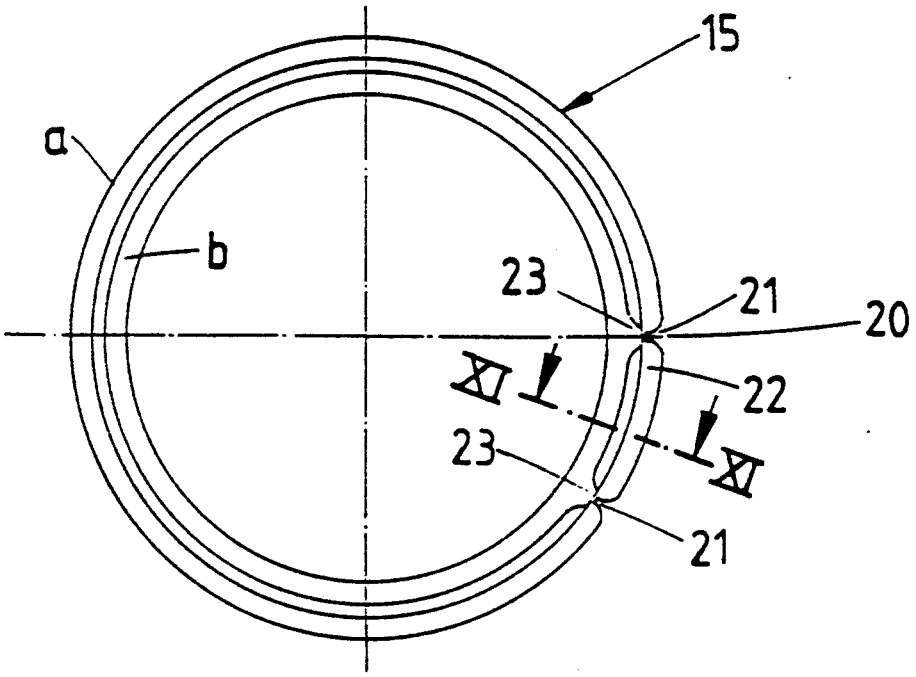
FIG. 10 is a bottom view thereof.

As can be noted particularly clearly from FIG. 9, the intended break point 21 is continued in an upward directed grip tab 22. The latter extends over the top of a sliding ring 19 so that it can be freely gripped. In the region of the lines of intended breakage the annular rib 16 which otherwise passes without interruption, is reduced in thickness. Reference is had to FIG. 10. There, the corresponding constrictions 23 can clearly be noted on the inner side. In this way, there remains in the annular wall only a bridge of material of small cross section, which however is nevertheless still so stable that it requires an intentional separating movement.

From FIG. 9 it can also be noted that the sliding ring 15 is of angular profile in cross section. The one, longer angle arm, designated a, forms the vertical annular wall, while the other, adjacent shorter angle arm, designated b, which is inwardly directed on top at a right angle, is guided by its inward directed end surface 24 on the outer surface M of the cap 8.

The angle arm b of the sliding ring which is guided on said outer surface M of the cap 8 however also still fulfills another function. This consists in the creation of a mating stop surface in combination with the attachment limitation of the sliding ring. On the cap side, the construction is such that the upper end surface 13' of the ledges 13 form the vertical limitation for the sliding ring 15 in position engaged on the cap 8. Without the ledges or their pressing action, the sliding ring could be displaced further beyond the pressing position. In such case, the pressing would no longer be present and there would be a jamming and inward pushing of the locking tongue on the inner diameter of the sliding ring 15 which rests against the outer wall M of the closure cap V.

The intended place of breakage 20 continues uniformly also in the inward directed angle arm b. As guide surface there serves approximately half the height of the cap 8, namely extending from the roots, lying at the same height, of the individual tongues 10 and locking tongues 19 up to the cover 14.

In the interest of a balanced cap loading, the individual tongues 10 and the locking tongues 9 are distributed in alternating sequence on the circumference of the cap 8. As a whole, there are six individual tongues 10 with a corresponding number of bent-out locking tongues 19 between them. The width of the individual tongues 10 is one-third greater than that of the locking tongues 19. The vertical free-cuts which divide the tongues bear the reference number 25.

Within the vicinity of the lid-side cap edge below the lid 14 of the cap 8, there is developed a knife-edge-like annular seal 26 which is embedded into the surface of the relatively soft material of the stopper 6. With respect to its softness there are necessary values which permit the penetration of a cannula and provide such a restoration that the punctured opening is automatically closed again.

Figure 5:
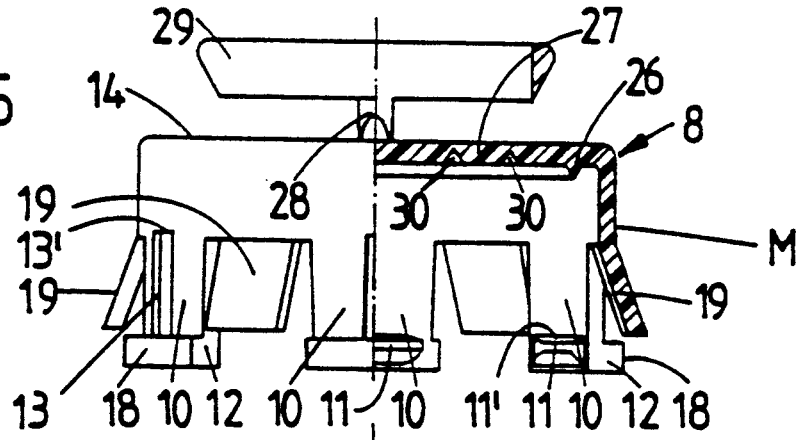
FIG. 5 shows the cover of the closure cover in a half section.
Figure 6:
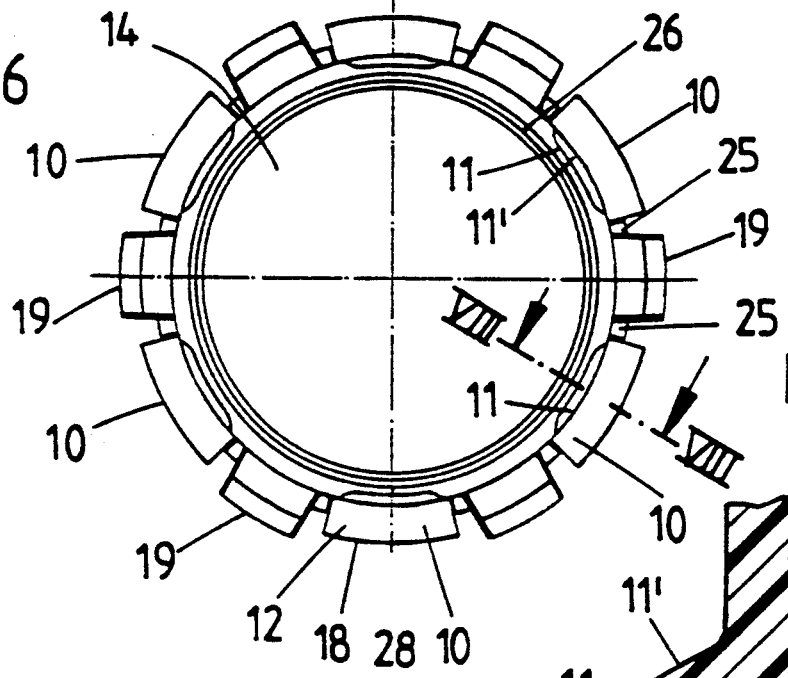
FIG. 6 is an inside view thereof.
Figure 7:
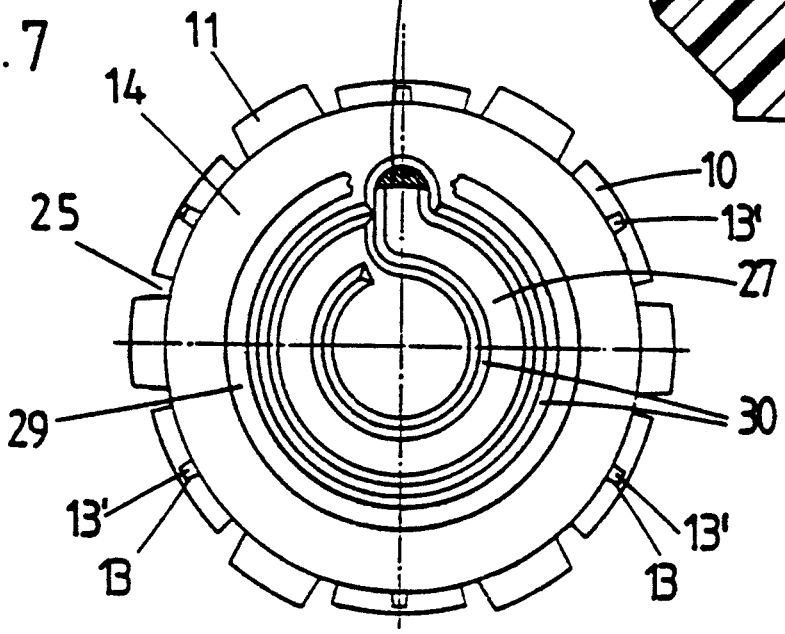
FIG. 7 is a top view of the cap with the tear tab arranged on its top.

The corresponding access is obtained by a tear tab formed by an approximately closed annular surface 27 in the region of the center of the top 14 of the cap 8. The annular surface 27 extends somewhat radially outward, forming an axially extending pull arm 28. Adjoining the latter on its top is a ring 29. The latter extends freely over and parallel to the top 14 of the cap 8. As a whole, there is a course of the ring approximately in the shape of a question mark, defined by a pair of break grooves 30, produced upon the injection molding, on the bottom or top of the top 14. FIG. 5 shows them inside the cap 8 and FIG. 7, outside.

The operation, summarized briefly, is as follows:

After insertion of the stopper 6 into the mouth 5 of the bottle 2, the cap 8 is placed thereover. Its individual tongues 10 engage on the undergrip locking shoulder 4. This is followed by the placing on of the sliding ring 15 the displacement of which is limited by the end surface 13' and by the lower side of the angle arm b. The sliding ring is guided on the outer wall M. The annular rib 16 moves over the back of the resilient locking tongues 19 which move back for a short time, and it finally snaps in position below the front end of these locking tongues 10, which move back again into the basic position. An irreversible detent connection is present. The vertex 17 of the annular rib 16 presses against the back, i.e. the end surface 18, of the individual tongues 10 so that the sliding ring 15 lies like a hoop around the ring of individual tongues. An upward directed pull on the closure cap V is generally not capable of eliminating the flange-like underengagement.

For the removal of the contents, it is merely necessary, on the other hand, to pull off the ring surface 27. There is thus produced a central opening in the cover 14, defined by the outer of the two concentric intended-break grooves 30, which permits the passage of the cannula.

I claim:

1. A closure cover for an infusion or transfusion bottle, the bottle having a neck with an outwardly extending bead, the cover comprising:

a stopper configured for insertion into the bottle neck;

a cap extending over the stopper, the cap being anchored by undergripping about the bead of the bottle neck upon emplacement of the cap upon the bottle neck, the cap having a tab and a plurality of resilient tongues disposed circumferentially around the cap, the tongues extending over the neck for gripping the bead of the neck;

a ring slidable over the tongues, the ring surrounding and pressing the tongues against the bead for securing the cap to the bead; and wherein the tab is disposed between successive ones of said tongues and extends away from the neck to engage the ring to secure the ring in a pressing position.

2. A closure cover for an infusion or transfusion bottle, the bottle having a neck with an outwardly extending bead, the cover comprising:

a stopper configured for insertion into the bottle neck;

a cap extending over the stopper, the cap being anchored by undergripping about the bead of the bottle neck, the cap having a plurality of resilient tongues extending over the neck for gripping the bead of the neck;

a ring slidable over the tongues, the ring surrounding and pressing the tongues against the bead for securing the cap to the bead; and wherein the ring comprises an annular pressing means for pressing the tongues against the bead; and the cap comprises a tab extending away from the neck to engage the pressing means to secure the sliding ring in a pressing position;

there are a plurality of said tabs, and the tongues and the tabs are arranged in alternating sequence along a circumference of the cap.

3. A closure cover for an infusion or transfusion bottle, the bottle having a neck with an outwardly extending bead, the cover comprising:

a stopper configured for insertion into the bottle neck;

a cap extending over the stopper, the cap being anchored by undergripping about the bead of the bottle neck, the cap having a plurality of resilient tongues extending over the neck for gripping the bead of the neck;

a ring slidable over the tongues, the ring surrounding and pressing the tongues against the bead for securing the cap to the bead; and wherein the ring comprises an annular pressing means for pressing the tongues against the bead; and the cap comprises a tab extending away from the neck to engage the pressing means to secure the sliding ring in a pressing position;

said sliding ring includes an annular element directed radially inward toward the stopper for engaging an outer surface of the cap in a region above root portions of the tongues and said tab.

4. A closure cover for an infusion or transfusion bottle, the bottle having a neck with an outwardly extending bead, the cover comprising:

a stopper configured for insertion into the bottle neck;

a cap extending over the stopper, the cap being anchored by undergripping about the bead of the bottle neck upon emplacement of the cap upon the bottle neck, the cap having at least one tab and a plurality of resilient tongues disposed circumferentially around the cap, the tongues extending over the neck for gripping the bead of the neck, said at least one tab and said tongues being disposed in alternating sequence around the cap;

a ring slidable over the tongues, the ring surrounding and pressing the tongues against the bead for securing the cap to the bead; and wherein the ring comprises an annular pressing means for pressing the tongues against the bead, said at least one tab extending away from the neck to engage the pressing means to secure the sliding ring in a pressing position; and the cap comprises an annular surface defining a tear tab and located in a region of the center of a top of the cap.

5. A closure cover according to claim 4, wherein the cap includes intended-breakage grooves impressed on an inner side of the cap to define a boundary of the annular surface.

6. A closure cover for an infusion or transfusion bottle, the bottle having a neck with an outwardly extending bead, the cover comprising:

a stopper configured for insertion into the bottle neck;

a cap extending over the stopper, the cap being anchored by undergripping about the bead of the bottle neck, the cap having a plurality of resilient tongues extending over the neck for gripping the bead of the neck;

a ring slidable over the tongues, the ring surrounding and pressing the tongues against the bead for securing the cap to the bead; and wherein the ring comprises an annular pressing means for pressing the tongues against the bead;

the cap comprises a tab extending away from the neck to engage the pressing means to secure the sliding ring in pressing position;

the pressing means of the sliding ring comprises an annular rib of nose shape in cross section, with a rounded vertex; and respective ones of the tongues include outwardly directed beads having end surfaces each of which forms a pressing point for the annular rib.

7. A closure cover according to claim 6, wherein an underflank of the annular rib is developed as a run-on bevel.

8. A closure cover according to claim 6, wherein an upper flank of the annular rib serves as a locking flank which cooperates with said tab for securing the ring into the position of pressing the tongues.

9. A closure cover according to claim 6, wherein the cap comprises a plurality of ledges located on respective ones of said tongues and extending toward an outer end of each tongue, the tongues being stiffened by the ledges.

10. A closure cover according to claim 9, wherein upon emplacement of the closure cover upon the bottle neck, upper end surfaces of the ledges restrict movement of the ring, along an axis of the cap, toward a bottom of the bottle.

11. A closure cover according to claim 10, wherein the ring has an annular element serving as a counterstop for abutting the upper end surfaces of the ledges of the cap.

12. A closure cover for an infusion or transfusion bottle, the bottle having a neck with an outwardly extending bead, the cover comprising:

a stopper configured for insertion into the bottle neck;

a cap extending over the stopper, the cap being anchored by undergripping about the bead of the bottle neck upon emplacement of the cap upon the bottle neck, the cap having at least one tab and a plurality of resilient tongues disposed circumferentially around the cap, the tongues extending over the neck for gripping the bead of the neck, said at least one tab and said tongues being disposed in alternating sequence around the cap;

a ring slidable over the tongues, the ring surrounding and pressing the tongues against the bead for securing the cap to the bead; and wherein the ring comprises an annular pressing means for pressing the tongues against the bead, said at least one tab extending away from the neck to engage the pressing means to secure the sliding ring in pressing position; and the sliding ring is provided with a place of intended breakage.

13. A closure cover for a bottle, the bottle having a neck with an outwardly extending bead, the cover comprising:

a stopper configured for insertion into the bottle neck;

a cap extending over the stopper upon emplacement of the cap upon the bottle neck, the cap having a plurality of resilient tongues disposed circumferentially around the cap, the tongues extending over the bead of the neck for gripping the bead;

a ring slidable over the tongues, the ring surrounding and pressing the tongues against the bead for securing the cap to the bead; and wherein the cap comprises tab means disposed circumferentially around the cap and interspersed among the tongues, the tab means extending over the bead and being biased away from the bead to engage the ring to secure the ring about the tongues.

14. A closure cover according to claim 13, wherein said tab means includes tabs spaced from the tongues.

15. A closure cover according to claim 13, wherein said tab means comprises a plurality of tabs interleaved with the tongues.

16. A closure cover according to claim 15, wherein the ring has an inwardly extending protuberance means for engaging said tongues.

17. A closure cover for a bottle, the bottle having a neck with an outwardly extending bead, the cover comprising:

a stopper configured for insertion into the bottle neck;

a cap extending over the stopper upon emplacement of the cap upon the bottle neck, the cap having a plurality of resilient tongues disposed circumferentially around the cap, the tongues extending over the bead of the neck for gripping the bead;

a sliding ring slidable over the tongues, the ring comprising pressing means surrounding and pressing the tongues against the bead for securing the cap to the bead; and wherein the cap comprises tab means disposed circumferentially around the cap and interspersed among the tongues, the tab means extending over the bead and being biased away from the bead to engage the ring to secure the ring about the tongues;

the pressing mean of the sliding ring comprises an annular rib of nose shape in cross section, with a rounded vertex; and respective ones of the tongues include outwardly directed beads having end surfaces each of which forms a pressing point for the annular rib.

* * * * *